US011420841B2

(12) United States Patent
Ebihara

(10) Patent No.: US 11,420,841 B2
(45) Date of Patent: Aug. 23, 2022

(54) SHEET STACKER AND IMAGE FORMING SYSTEM INCORPORATING THE SHEET STACKER

(71) Applicant: Takashi Ebihara, Ibaraki (JP)

(72) Inventor: Takashi Ebihara, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/460,999

(22) Filed: Aug. 30, 2021

(65) Prior Publication Data

US 2022/0073308 A1 Mar. 10, 2022

(30) Foreign Application Priority Data

Sep. 7, 2020 (JP) ..... JP2020-149611

(51) Int. Cl.
*B65H 9/20* (2006.01)
*B65H 43/00* (2006.01)
*B65H 31/34* (2006.01)

(52) U.S. Cl.
CPC ..... *B65H 43/00* (2013.01); *B65H 31/34* (2013.01)

(58) Field of Classification Search
CPC . B65H 9/10; B65H 9/101; B65H 9/20; B65H 2408/114; B65H 2301/36; B65H 2301/363; B65H 2301/362; B65H 31/34; B65H 43/00; B65H 43/08
USPC ..... 270/58.12, 58.16, 58.17, 58.27
See application file for complete search history.

(56) References Cited

U.S. PATENT DOCUMENTS 4,657,239 A * 4/1987 Ikesue ..... B65H 9/101 271/227
5,172,138 A * 12/1992 Okazawa ..... B65H 5/38 271/240
5,857,670 A * 1/1999 Jung ..... B42C 1/125 270/58.12
7,690,648 B2 * 4/2010 Utsumi ..... B65H 9/101 271/240
7,934,713 B2 * 5/2011 Suzuki ..... G03G 15/6552 270/58.12
9,350,887 B2 * 5/2016 Wang ..... H04N 1/00559
9,926,153 B2 * 3/2018 Kubota ..... B65H 7/02

FOREIGN PATENT DOCUMENTS

| | | |
|---|---|---|
| JP | 59-214046 | 12/1984 |
| JP | 9-077274 | 3/1997 |
| JP | 2005-239322 | 9/2005 |
| JP | 2019-077506 | 5/2019 |

* cited by examiner

*Primary Examiner* — Leslie A Nicholson, III
(74) *Attorney, Agent, or Firm* — Harness, Dickey & Pierce, P.L.C.

(57) ABSTRACT

A sheet stacker includes a housing, a fence, a first distance measurement sensor, and a second distance measurement sensor. The fence is movable in a fence moving direction on the housing and is configured to regulate a position of an end of a sheet. The first distance measurement sensor is configured to measure a distance between the fence and a first portion of the housing, the first portion being on one side of the housing with respect to the fence in the fence moving direction. The second distance measurement sensor is configured to measure a distance between the fence and a second portion of the housing, the second portion being on another side of the housing with respect to the fence in the fence moving direction.

10 Claims, 9 Drawing Sheets

SHEET STACKER AND IMAGE FORMING SYSTEM INCORPORATING THE SHEET STACKER

CROSS-REFERENCE TO RELATED APPLICATION

This patent application is based on and claims priority pursuant to 35 U.S.C. § 119(a) to Japanese Patent Application No. 2020-149611, filed on Sep. 7, 2020, in the Japan Patent Office, the entire disclosure of which is hereby incorporated by reference herein.

BACKGROUND

Technical Field

Embodiments of the present disclosure relate to a sheet stacker and an image forming system incorporating the sheet stacker.

Background Art

Various types of sheet stackers are known to include a fence that is movably disposed to regulate the position of an end of a sheet.

A known sheet stacker handles two types of sheets, which are A4-size sheet and A3-size sheet. The known sheet stacker includes first and second sheet size sensors, each specifying the size of a sheet, at the respective positions of trailing end regulation plates (fences). One trailing end regulation plate (fence) regulates the trailing end of an A4-size sheet and another trailing end regulation plate (fence) regulates the trailing end of an A3-size sheet.

SUMMARY

Embodiments of the present disclosure described herein provide a novel sheet stacker including a housing, a fence, a first distance measurement sensor, and a second distance measurement sensor. The fence is movable in a fence moving direction on the housing and is configured to regulate a position of an end of a sheet. The first distance measurement sensor is configured to measure a distance between the fence and a first portion of the housing, the first portion being on one side of the housing with respect to the fence in the fence moving direction. The second distance measurement sensor is configured to measure a distance between the fence and a second portion of the housing, the second portion being on another side of the housing with respect to the fence in the fence moving direction.

Further, embodiments of the present disclosure described herein provide an image forming system including the above-described sheet stacker and an image forming apparatus configured to form an image on the sheet fed by the sheet stacker.

BRIEF DESCRIPTION OF THE SEVERAL VIEWS OF THE DRAWINGS

Exemplary embodiments of this disclosure will be described in detail based on the following figures, wherein.

Figure 1:
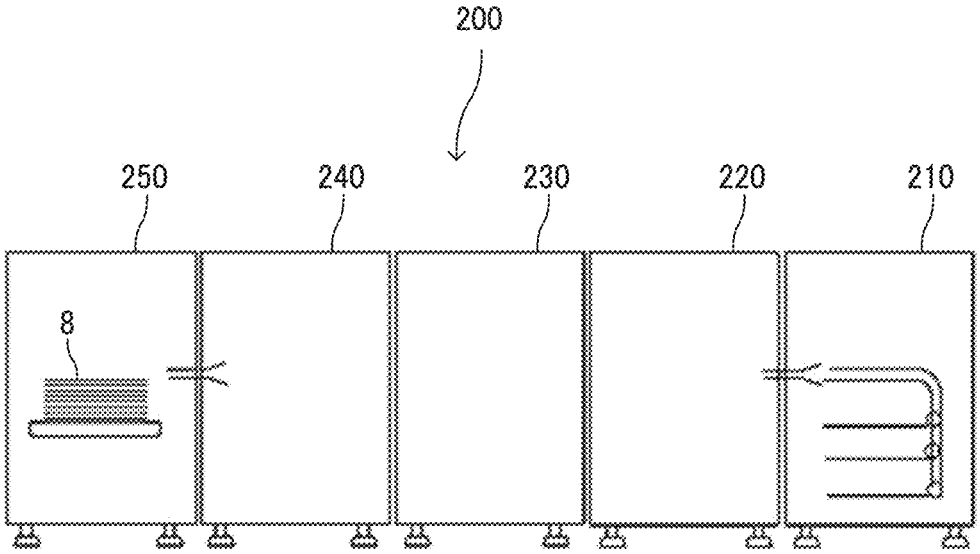
FIG. 1 is a diagram illustrating an overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Next, a description is given of a configuration and functions of a sheet stacker and an image forming system incorporating the sheet stacker, according to an embodiment of the present disclosure, with reference to drawings. Note that identical parts or equivalents are given identical reference numerals and redundant descriptions are summarized or omitted accordingly.

Now, a description is given of a sheet feeding device that functions as a sheet loader provided with a sheet feeding unit, in an image forming system according to an embodiment of the present disclosure.

FIG. 1 is a diagram illustrating an overall configuration of an image forming system 200 according to an embodiment of the present disclosure.

As illustrated in FIG. 1, the image forming system 200 includes a sheet feeding device 210, a pre-processing liquid applying device 220, an inkjet printer 230, a drying device 240, and a sheet ejecting device 250.

The sheet feeding device 210 feeds and supplies a sheet 8 that functions as a recording medium (e.g., a cut sheet), to the pre-processing liquid applying device 220 that is disposed downstream in the sheet conveyance passage from the sheet feeding device 210 in the sheet conveyance direction. The pre-processing liquid applying device 220 applies pre-processing liquid to the sheet 8. Such application of the pre-processing liquid prevents bleeding and bleed-through of ink for inkjet printing. The pre-processing liquid applying device 220 includes a reverse sheet conveyance passage. According to this configuration, when performing duplex printing, the sheet 8 on the front face of which the pre-processing liquid is applied is reversed in the reverse sheet conveyance passage, so as to apply the pre-processing liquid on the back face of the sheet 8 in addition to the front face.

After the pre-processing liquid applying device 220 applies the pre-processing liquid onto the sheet 8, the inkjet printer 230 discharges ink droplets onto the front face of the sheet 8 to form an image. The drying device 240 includes a dryer that dries the image formed by the inkjet printer 230, on the front face of the sheet 8. When printing on the front and back sides of the sheet 8, the sheet 8 passes through the sheet conveyance passage to return to the inkjet printer 230 from the drying device 240. After the inkjet printer 230 discharges ink droplets on the front face of the sheet 8, that is, the opposite face of the sheet 8 before the reverse of the sheet 8, to form an image, the drying device 240 dries the image formed on the front face of the sheet 8 (the opposite face of the sheet 8 before the reverse of the sheet 8). Then, the sheet 8 is ejected to the sheet ejecting device 250.

Figure 2A:
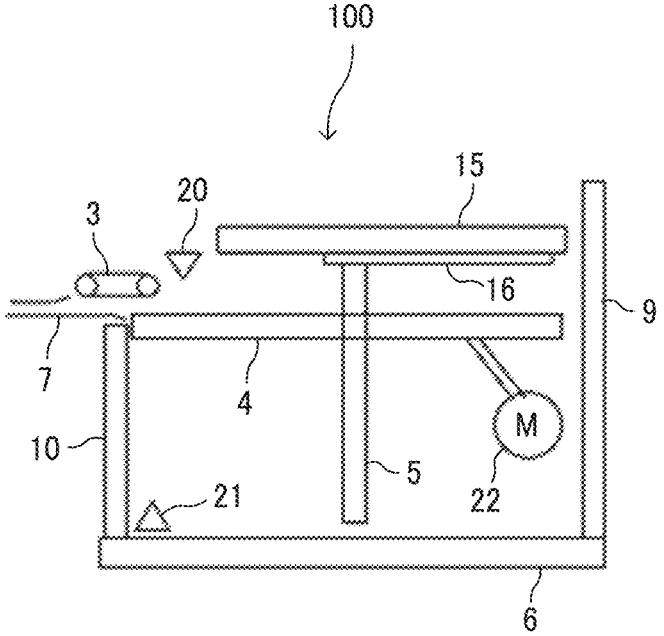
FIGS. 2A and 2B are diagrams, each illustrating a schematic configuration of a sheet feed tray that functions as a sheet stacker included in a sheet feeding device of the image forming system of FIG. 1.
Figure 2B:
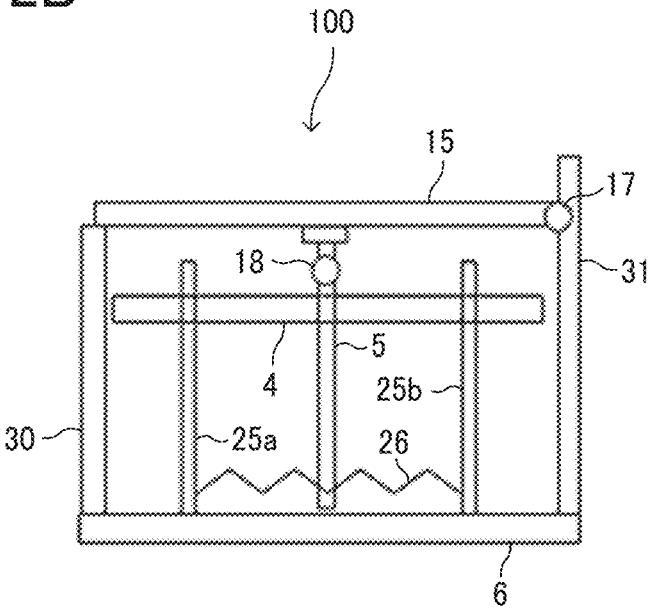

FIGS. 2A and 2B are diagrams, each illustrating a schematic configuration of a sheet feed tray 100 that functions as a sheet stacker included in the sheet feeding device 210 of the image forming system 200 of FIG. 1.

FIG. 2A is a front view of the sheet feed tray 100 in which a sheet is fed from right to left in the drawing.

FIG. 2B is a side view from the left of the sheet feed tray 100.

The sheet feed tray 100 includes a box-shaped frame (housing) including a bottom plate 6, a rear side panel 9, a front side panel 10, and side panels 30 and 31 on the left and right sides. The sheet feed tray 100 includes an elevation table 4 in the frame. The elevation table 4 is vertically movable by being driven by a motor 22. The sheet feed tray 100 further includes position sensors 20 and 21 at vertical positions (i.e., upper and lower positions) to the elevation range of the elevation table 4. When the elevation table 4 moves upward, the position sensor 20 detects the upper face of the elevation table 4. In response to the detection, the elevation table 4 is stopped at the predetermined (upper) position. Similarly, when the elevation table 4 moves downward, the position sensor 21 detects the bottom face of the elevation table 4. In response to the detection, the elevation table 4 is stopped at the predetermined (lower) position.

Side fences 25*a* and 25*b* are disposed on the left and right sides of the elevation table 4. The positions of the side fences 25*a* and 25*b* are movable along the size of the sheet 8 set on the elevation table 4. The side fences 25*a* and 25*b* are left and right side fences 25*a* and 25*b* moving together by a coupling portion 26. Each of the left and right side fences 25*a* and 25*b* regulates the position of the lateral end of the sheet 8, in other words, the position of both ends in the width direction of the sheet 8.

An end fence 5 is disposed at the trailing end of the sheet 8. The position of the end fence 5 is changeable, so that the end fence 5 regulates the position of the trailing end of the sheet 8. Specifically, the end fence 5 regulates the position of the upstream end of the sheet 8 in the sheet feeding direction in a state in which the downstream end of the sheet 8 in the sheet feeding direction is in contact with the front side panel 10. The end fence 5 is movable in the longitudinal direction (sheet feeding direction) of a guide rail 16 that is fixed to a guide frame 15 that is disposed above the end fence 5. In other words, the position change direction corresponds to the sheet feeding direction. The guide frame 15 is fixed to the side panel 31 via a plurality of rotary hinges 17. Each of the plurality of rotary hinges 17 is rotatable. The guide rail 16 guides the end fence 5 to move in the sheet feeding direction, so that the end fence 5 may be fixed at any position in the longitudinal direction of the guide rail 16. The end fence 5 is fixed to any position according to various sheet sizes. Further, a rotary hinge 18 is rotatably disposed at a part of the end fence 5.

As the elevation table 4 moves upward, the position sensor 20 detects the elevation table 4. In response to the detection by the position sensor 20, the elevation table 4 stops at a predetermined position. A plurality of pickup belts 3 are disposed at the predetermined position facing the downstream portion of the elevation table 4 in the sheet feeding direction. Each pickup belt 3 has a plurality of suction holes so that a suction fan sucks the sheet 8 to be attracted to the pickup belt 3. Due to such a configuration, when the sheets are stacked on the elevation table 4, the sheets on the elevation table 4 are conveyed one by one by the pickup belt 3. The pickup belt 3, the suction fan, and a drive device that drives the pickup belt 3 are included in a sheet feeder.

Figure 3:
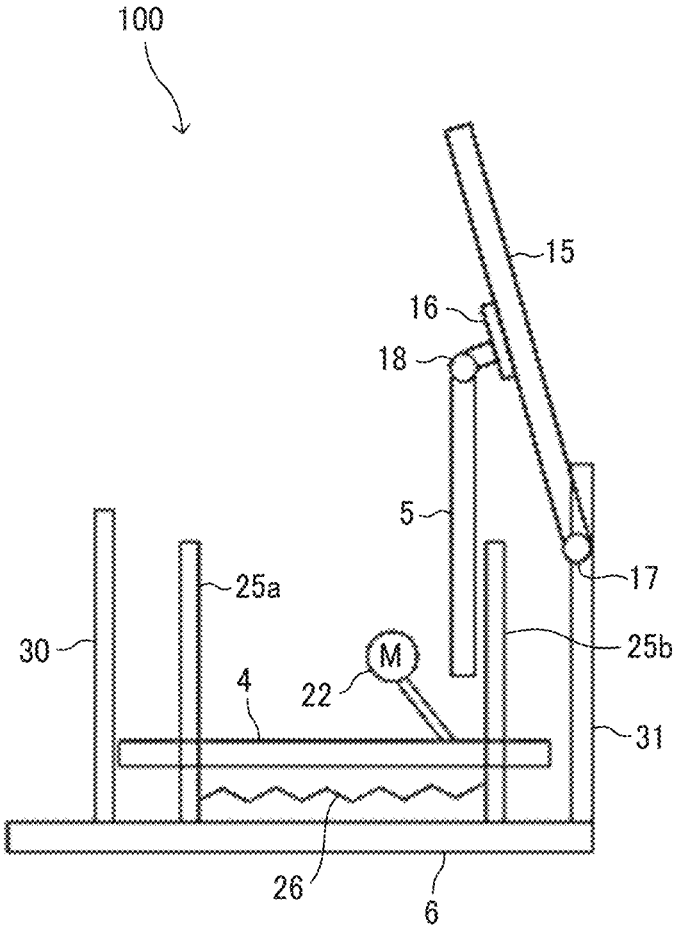
FIG. 3 is a diagram illustrating movement of a guide frame and an end fence included in the sheet feed tray of FIGS. 2A and 2B, when setting a sheet in the sheet feed tray.

FIG. 3 is a diagram illustrating movement of the guide frame and the end fence included in the sheet feed tray of FIGS. 2A and 2B, when setting a sheet in the sheet feed tray.

FIG. 3 illustrates the state in which the elevation table 4 is moved downward by the motor 22 and stopped in response to the detection of the position of the elevation table 4 by the position sensor 21. The sheet feed tray 100 is drawn from the sheet feeding device 210 and the guide frame 15 is lifted while being supported by the plurality of rotary hinges 17 as a shaft. At this time, the guide rail 16 that is fixed to the guide frame 15 is lifted together with the movement of the guide frame 15. The end fence 5 that is coupled to the guide rail 16 moves in the vertical direction by the rotary hinge 18, so that the end fence 5 does not hinder when the sheet 8 is set on the elevation table 4. Further, the plurality of rotary hinges 17 apply torque in a single direction in which the guide frame 15 falls. Accordingly, when sheets are set on the elevation table 4, the guide frame 15 does not fall even if a user releases the guide frame 15.

As the side fences 25*a* and 25*b* are moved according to the width of the sheet 8 set on the elevation table 4 and the guide frame 15 falls while being supported by the plurality of rotary hinges 17 as a shaft, the angle of the guide frame 15 changes. The end fence 5 is supported by the rotary hinge 18 as a shaft and is constantly weighted by the own weight in the vertical direction. Due to this configuration, when the guide frame 15 is pushed down, the end fence 5 returns to the predetermined position. Then, the end fence 5 and the side fences 25*a* and 25*b* are moved to the predetermined positions according to the length and width of the sheets set on the elevation table 4.

Figure 4:
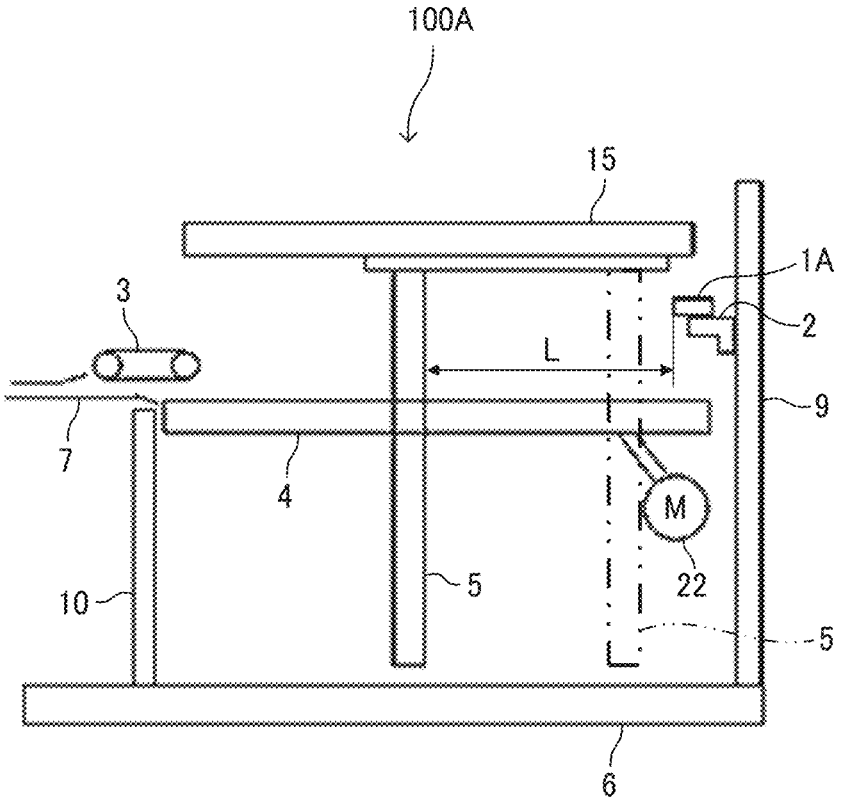
FIG. 4 is a diagram illustrating a schematic configuration of a comparative sheet feed tray, focusing on the layout of sensors detecting the position of an end fence in the comparative sheet feed tray.

FIG. 4 is a diagram illustrating a schematic configuration of a comparative sheet feed tray 100A, focusing on the layout of sensor detecting the position of the end fence 5 in the comparative sheet feed tray 100A.

Note that the comparative sheet feed tray 100A includes various members that share the names and reference numerals with the members illustrated in FIG. 3. The comparative sheet feed tray 100A includes a distance measurement sensor 1A as a single sensor that detects the position of the end fence 5. As illustrated in FIG. 4, the distance measurement sensor 1A is fixed to the rear side panel 9 via a bracket 2.

In a case in which a sheet having the maximum sheet length is set on the elevation table 4, the end fence 5 moves to a position farthest from the pickup belt 3 as indicated with a virtual line (two-dot chain line) as illustrated in FIG. 4. The distance measurement sensor 1A is disposed outside the position of the maximum sheet length of the end fence 5. In other words, the distance measurement sensor 1A is disposed outside the stacking range of the sheet having the maximum sheet length. In a state in which the end fence 5 is fixed to the position of the maximum sheet length, the end fence 5 is located at the minimum distance from the distance measurement sensor 1A. By contrast, in a case in which a sheet having the minimum sheet length is set on the elevation table 4, the end fence 5 moves to a position nearest from the pickup belt 3 as indicated with a solid line as illustrated in FIG. 4. In this case, the distance between the end fence 5 and the distance measurement sensor 1A is the maximum move distance L. Accordingly, the detection distance of the distance measurement sensor 1A is required by a distance L+a.

The position to fix the end fence 5 depends on the sheet to be used. Therefore, the distance measurement sensor 1A that functions as a distance measurement sensor may need to avoid detecting a non-target obstacle as the detection distance increases. In FIG. 4, the distance measurement sensor 1A of the comparative sheet feed tray 100A is disposed above the uppermost position of the elevation table 4. Apart from this example, the single distance measurement sensor 1A may be disposed below the lowermost position of the elevation table 4 or inside the minimum sheet length position of the end fence 5.

Figure 5:
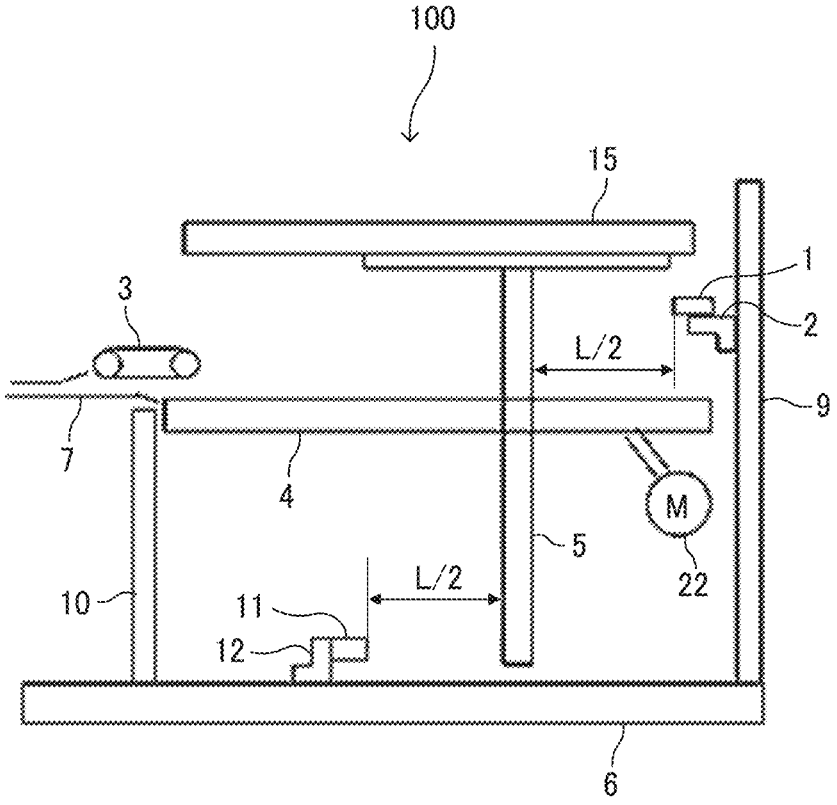
FIG. 5 is a diagram illustrating a schematic configuration of the sheet feed tray according to an embodiment of the present disclosure, focusing on the layout of sensors detecting the position of the end fence.

FIG. 5 is a diagram illustrating a schematic configuration of the sheet feed tray 100 according to an embodiment of the present disclosure, focusing on the layout of sensors detecting the position of the end fence 5.

In order to detect the position of the end fence 5, the sheet feed tray 100 according to an embodiment of the present disclosure includes a first distance measurement sensor 1 that functions as a first distance measurement sensor and a second distance measurement sensor 11 that functions as a second distance measurement sensor. Each of the first distance measurement sensor 1 and the second distance measurement sensor 11 measures the distance to the end fence 5. The first distance measurement sensor 1 measures the distance between a first portion of the housing of the sheet feed tray 100 on one side of the movement direction of the end fence 5. The second distance measurement sensor 11 measures the distance between a second portion of the housing of the sheet feed tray 100 on the opposite side, which is opposite the one side, of the movement direction of the end fence 5.

The first distance measurement sensor 1 and the second distance measurement sensor 11 may be any kind of sensors as long as the first distance measurement sensor 1 and the second distance measurement sensor 11 are capable of detecting the distance between the end fence 5 and each of the respective portions of the housing of the sheet feed tray 100. Specifically, the first distance measurement sensor 1 and the second distance measurement sensor 11 may detect the distance optically or with radio waves or ultrasound waves.

More specifically, the first distance measurement sensor 1 that is attached to the bracket 2 is disposed outside the position of the end fence 5 that corresponds to the maximum length of a sheet to be stacked on the elevation table 4. This position at which the first distance measurement sensor 1 is disposed is the first portion. The bracket 2 is attached to the rear side panel 9. The first distance measurement sensor 1 is disposed higher than the uppermost position of the elevation table 4, so as to detect the position of the end fence 5. Similarly, the second distance measurement sensor 11 that is attached to a bracket 12 is disposed inside the position of the end fence 5 that corresponds to the minimum length of a sheet to be stacked on the elevation table 4. This position at which the second distance measurement sensor 11 is disposed is the second portion. The bracket 12 is attached to the bottom plate 6. The second distance measurement sensor 11 is disposed lower than the lowermost position of the elevation table 4, so as to detect the end fence 5 at the position lower than the elevation table 4.

Further, the first distance measurement sensor 1 disposed higher than the uppermost position of the elevation table 4 and the second distance measurement sensor 11 disposed lower than the lowermost position of the elevation table 4 are attached facing each other. Due to this configuration, with respect to the maximum move distance L of the end fence 5, each of the detection distance of the first distance measurement sensor 1 and the detection distance of the second distance measurement sensor 11 is $(L/2)+\alpha$. Accordingly, the first distance measurement sensor 1 or the second distance measurement sensor 11 do not fail to detect the position of the end fence 5 wherever the position of the end fence 5 falls within the range of the movement distance.

Figure 6:
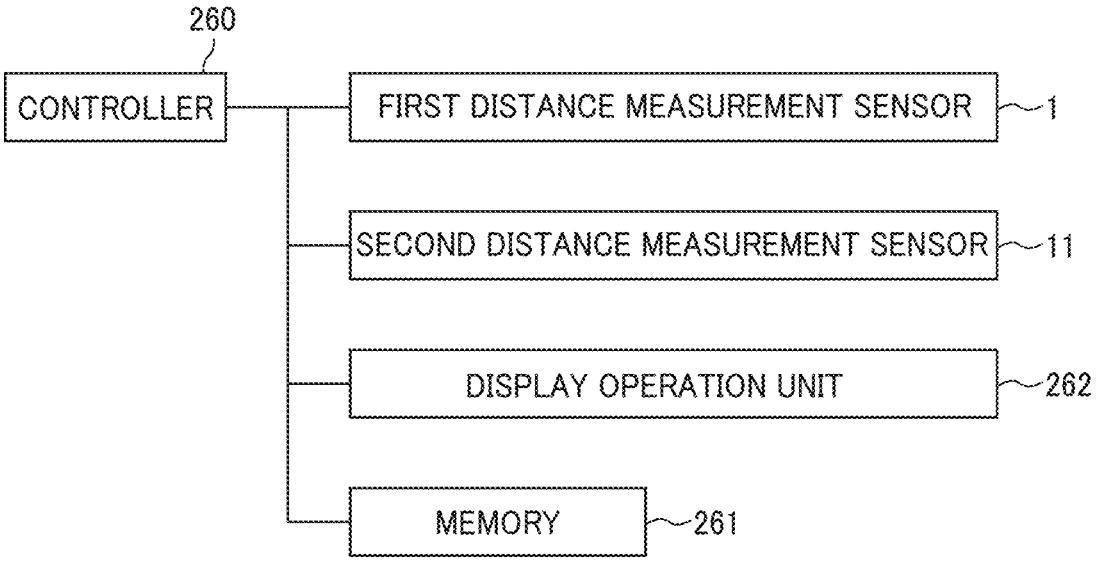
FIG. 6 is a block diagram illustrating electronical components of the image forming system of FIG. 1.

FIG. 6 is a block diagram illustrating electronical components of the image forming system of FIG. 1.

The image forming system 200 includes a controller 260, a memory 261, the first distance measurement sensor 1, the second distance measurement sensor 11, and a display operation unit 262 that functions as an operation control panel. The display operation unit 262 may be mounted on the upper face or the front face of the inkjet printer 230 or may be mounted as a separate unit from the inkjet printer 230. A user operates the display operation unit 262 to input information of the size of the sheet 8 as a printing target object, in other words, the size of the sheet 8 to be set on the sheet feeding device 210. The controller 260 causes the memory 261 to store the information of the size of the sheet 8 input by the user.

As the controller 260 receives a print job instruction by the operation of the user with the display operation unit 262 or a print job instruction via network, the position of the end fence 5 is specified based on the detection result of a sensor closer to the end fence 5, of the first distance measurement sensor 1 and the second distance measurement sensor 11. In other words, the controller 260 calculates the position of the end fence 5, based on the detection result of the sensor closer to the end fence 5, of the two distance measurement sensors. It is likely that the farther sensor has a detection error. Even if the detection is successful, it is likely that the farther sensor has a poor measurement accuracy since the sensor is disposed too far from the end fence 5 to detect the position correctly. It is not required to use the detection results of two distance measurement sensors simultaneously.

Then, the controller 260 compares the position of the end fence 5 specified based on the detection results of the two distance measurement sensors and information of the size of the sheet 8 stored in the memory 261, so as to determine whether or not the end fence 5 is located at the position corresponding to the size of sheet 8 stored in the memory 261. Specifically, the controller 260 determines whether the distance between the front side panel 10 and the end fence 5 matches the length of the sheet 8 in the sheet feeding direction.

When the controller 260 determines that the end fence 5 is located at the correct position, the controller 260 causes the sheet feeding device 210 to perform the sheet feeding operation on the sheet 8 set in the sheet feeding device 210. Then, an image based on the print job instruction issued by the inkjet printer 230 is printed on the sheet 8 fed from the sheet feeding device 210. By contrast, when the controller 260 determines that the end fence 5 is not located at the correct position, the controller 260 does not cause the sheet 8 to be fed from the sheet feed tray 100 and cause the display operation unit 262 to display a message that the position of the end fence 5 is not correct. This operations prevent occurrence of sheet feeding failure of the sheet 8 caused by the incorrect position of the end fence 5.

Figure 7A:
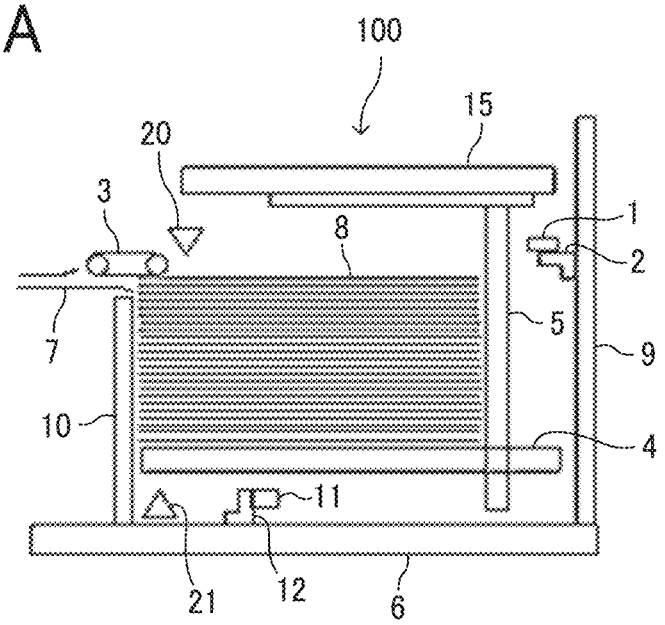
FIGS. 7A and 7B are diagrams, each illustrating the sheet feed tray on which sheets having the maximum length are stacked.
Figure 7B:
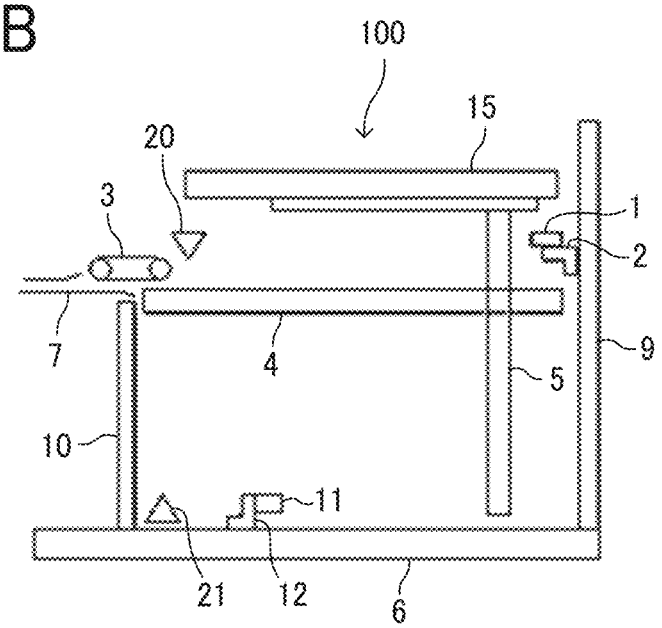

FIGS. 7A and 7B are diagrams, each illustrating the sheet feed tray 100 on which sheets having the maximum length are stacked.

FIG. 7A illustrates a state in which the maximum number (amount) of sheets 8 having the maximum settable length are stacked on the elevation table 4. The elevation table 4 moves upward to the position at which the upper face of the sheet 8 is detected by the position sensor 20. The pickup belt 3 is disposed at the position of the upper face of the sheet 8 detected by the position sensor 20. As the pickup belt 3 moves, the sheet 8 is conveyed to the guide plate 7.

The end fence 5 is set at the position farthest from the pickup belt 3, and therefore the distance of the end fence 5 and the first distance measurement sensor 1 is closest. The position of the end fence 5 is detected by the first distance measurement sensor 1 that is disposed relatively close to the end fence 5. When the whole sheets 8 are conveyed by the pickup belt 3 in the printing operation, the elevation table 4 moves upward and stops at the position at which the position sensor 20 detects the upper face of the elevation table 4. This movement is illustrated in FIG. 7B. Even in this case, the first distance measurement sensor 1 is located higher than the elevation table 4. Therefore, the first distance measurement sensor 1 correctly detects the distance to the end fence 5 without being blocked by the elevation table 4 or the sheets 8.

Figure 8A:
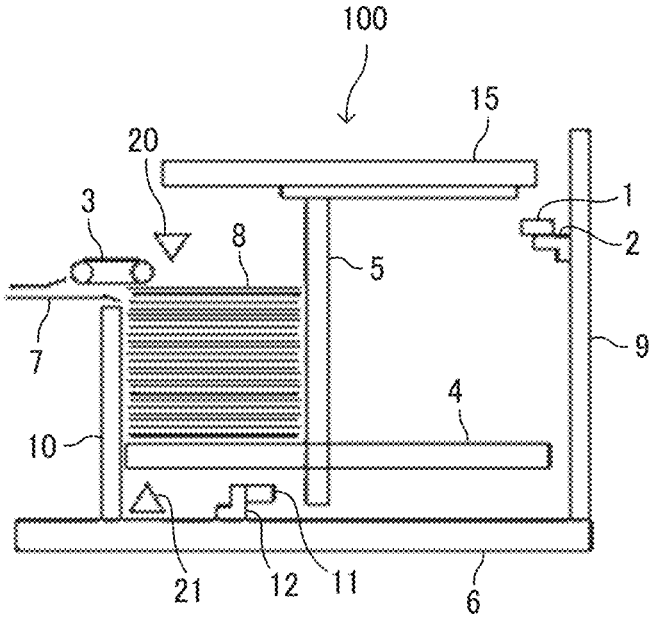
FIGS. 8A and 8B are diagrams, each illustrating the sheet feed tray on which sheets having the minimum length are stacked.
Figure 8B:
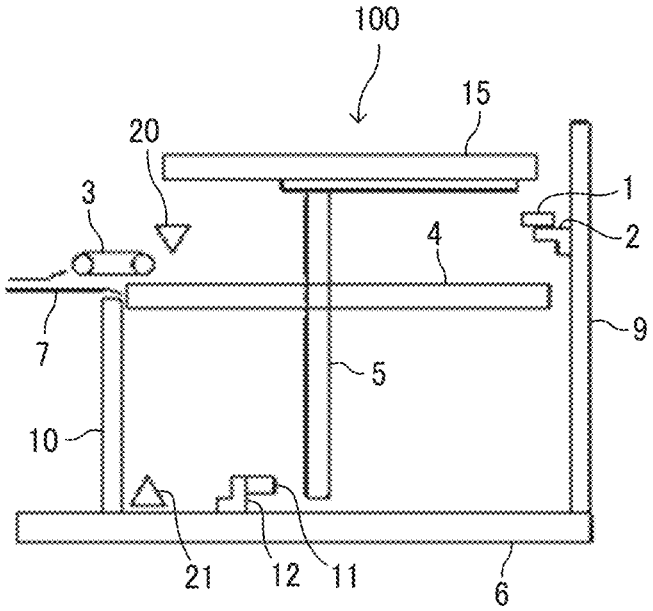

FIGS. 8A and 8B are diagrams, each illustrating the sheet feed tray 100 on which sheets having the minimum length are stacked.

FIG. 8A illustrates a state in which the maximum number (amount) of sheets 8 having the minimum settable length are stacked on the elevation table 4. The elevation table 4 moves upward to the position at which the upper face of the sheet 8 is detected by the position sensor 20. The pickup belt 3 is disposed at the position of the upper face of the sheet 8 detected by the position sensor 20. As the pickup belt 3 moves, the sheet 8 is conveyed to the guide plate 7.

The end fence 5 is set at the position nearest from the pickup belt 3, and therefore the distance of the end fence 5 and the second distance measurement sensor 11 is closest. The position of the end fence 5 is detected by the second distance measurement sensor 11 that is disposed relatively close to the end fence 5. When the whole sheets 8 are conveyed by the pickup belt 3 in the printing operation, the elevation table 4 moves upward and stops at the position at which the position sensor 20 detects the upper face of the elevation table 4. This movement is illustrated in FIG. 8B. Even in this case, the second distance measurement sensor 11 is located lower than the elevation table 4. Therefore, the second distance measurement sensor 11 correctly detects the distance to the end fence 5 without being blocked by the elevation table 4 or the sheets 8.

Figure 9:
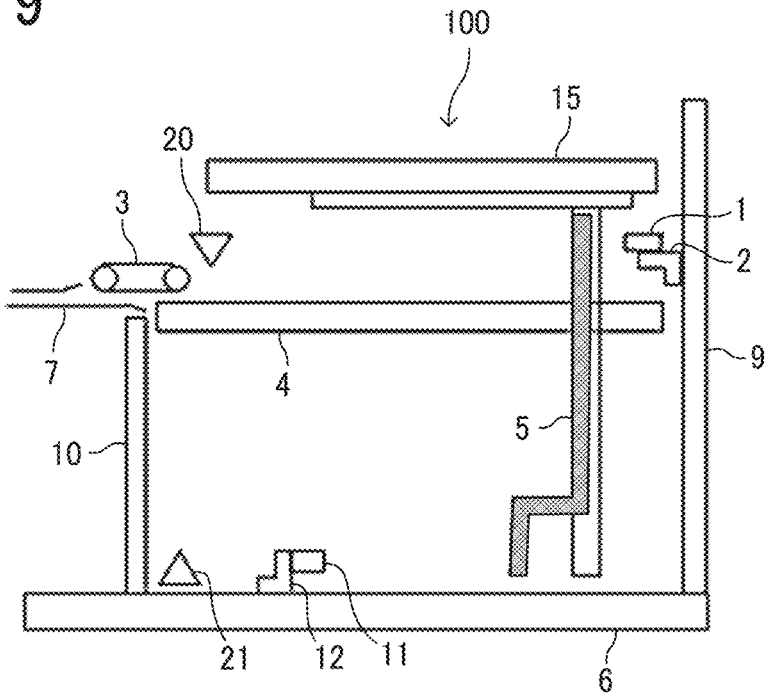
FIG. 9 is a diagram illustrating a variation of the sheet feed tray.

FIG. 9 is a diagram illustrating a variation of the sheet feed tray 100.

In the examples illustrated in FIGS. 2A to 8B, the end fence 5 has a linear cross section. However, as illustrated in FIG. 9, the end fence 5 may not have a linear cross section but may have a shape with offsets at a portion facing the first distance measurement sensor 1 and a portion facing the second distance measurement sensor 11. In other words, the portion facing the first distance measurement sensor 1 and the portion facing the second distance measurement sensor 11 may not be on the same straight line of the end fence 5. In detection of the position of the end fence 5 by the second distance measurement sensor 11 disposed offset from the trailing end of the sheet 8, the offset amount is considered to detect the position of the end fence 5.

Figure 10:
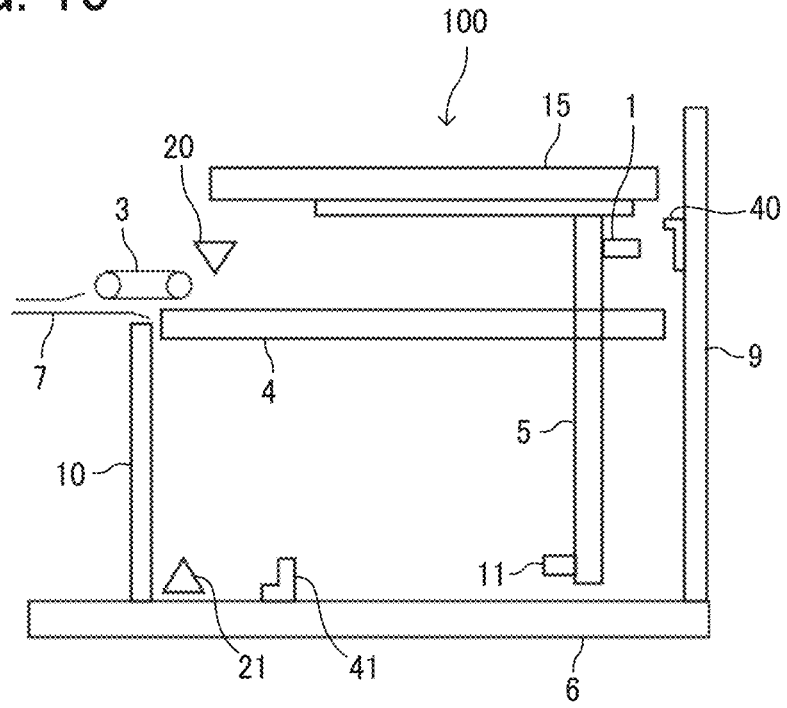
FIG. 10 is a diagram illustrating another variation of the sheet feed tray.

FIG. 10 is a diagram illustrating another variation of the sheet feed tray 100. In this variation, the first distance measurement sensor 1 and the second distance measurement sensor 11 are disposed on opposite faces of the end fence 5. A detection target portion 40 is mounted on the rear side panel 9 at a position facing the first distance measurement sensor 1. A detection target portion 41 is mounted on the bottom plate 6 at the same position as the second distance measurement sensor 11 to face the second distance measurement sensor 11.

As described above, according to the present embodiment, one of two distance measurement sensors mounted on the sheet feed tray measures the distance between the first portion on one side of the housing of the sheet feeding device in the movement direction of the end fence and the end fence, and another of the two distance measurement sensors measures the distance between the second portion on the opposite side of the housing of the sheet feeding device in the movement direction of the end fence and the end fence. Due to this configuration, even when the sheet feed tray handles three or more sizes of sheets, at least one of the two distance measurement sensors measures the position of the end fence to specify the size of the sheet on the sheet feed tray. With these operations, this configuration of the sheet feed tray prevents an increase in the number of sensors according to the size of sheets to be handled. Accordingly, such a simple configuration achieves accurate detection of various sizes of sheets set in the sheet feed tray.

Further, the sheet feed tray 100 includes two distance measurement sensors, each measuring the position of the end fence 5. Of the two distance measurement sensors of the sheet feed tray 100, the first distance measurement sensor 1 is disposed higher than the upper limit of the elevation table 4 and the second distance measurement sensor 11 is disposed lower than the lower limit of the elevation table 4. Due to this configuration, the distance measurement sensors (i.e., the first distance measurement sensor 1 and the second distance measurement sensor 11) of the sheet feed tray 100 correctly read the position of the end fence 5, regardless of the position of the elevation table 4 and the position of the sheet 8. Further, the measurement distance range of each of the first distance measurement sensor 1 and the second distance measurement sensor 11 is located at a position approximately a half of the distance of movement of the end fence 5. In addition, the first distance measurement sensor 1 and the second distance measurement sensor 11 are disposed facing each other. Accordingly, this configuration of the sheet feed tray 100 covers the entire moving range of the end fence 5 and achieves accurate detection of the position of the end fence 5 with a small number of components.

Note that such a configuration having distance measurement sensors is not limited to an end fence that regulates the position of the upstream end of a sheet in the sheet conveyance direction but may be applied to side fences that regulate and hold both ends of a sheet in the width direction. The configuration of the present embodiment is applied to a sheet stacker including a sheet feeder but may also be applied to a sheet stacker without a sheet feeder. Further, the configuration of the present embodiment is applied to an inkjet image forming apparatus but may also be applied to an electrophotographic image forming system. Further, the configuration of the present embodiment may be applied to a glosser that performs a glossing process on a sheet.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet stacker comprising:

a housing;

a fence movable in a fence moving direction on the housing, the fence being configured to regulate a position of an end of a sheet;

a first distance measurement sensor configured to measure a distance between the fence and a first portion of the housing, the first portion being on one side of the housing with respect to the fence in the fence moving direction; and a second distance measurement sensor configured to measure a distance between the fence and a second portion of the housing, the second portion being on another side of the housing with respect to the fence in the fence moving direction.

2. The sheet stacker according to claim 1, wherein at least one of the first distance measurement sensor and the second distance measurement sensor is disposed on a portion of the housing.

3. The sheet stacker according to claim 1, wherein at least one of the first distance measurement sensor and the second distance measurement sensor is disposed on the fence.

4. The sheet stacker according to claim 1, further comprising an elevation table configured to move the sheet in a vertical direction, wherein at least one of the first distance measurement sensor and the second distance measurement sensor is disposed higher than an uppermost position of movement of the elevation table.

5. The sheet stacker according to claim 4, wherein the at least one of the first distance measurement sensor and the second distance measurement sensor is disposed on a portion of the housing and is configured to measure a distance to the fence disposed higher than the elevation table.

6. The sheet stacker according to claim 1, further comprising an elevation table configured to move the sheet in a vertical direction, wherein at least one of the first distance measurement sensor and the second distance measurement sensor is disposed lower than a lowermost position of movement of the elevation table.

7. The sheet stacker according to claim 6, wherein the at least one of the first distance measurement sensor and the second distance measurement sensor is disposed on a portion of the housing and is configured to measure a distance to the fence disposed lower than the elevation table.

8. The sheet stacker according to claim 1, wherein at least one of the first distance measurement sensor and the second distance measurement sensor is disposed outside a stacking range of the sheet having a maximum length in the fence moving direction.

9. The sheet stacker according to claim 1, further comprising a sheet feeder disposed above an opposite end of the sheet to the fence in the fence moving direction.

10. An image forming system comprising:

the sheet stacker according to claim 9; and an image forming apparatus configured to form an image on the sheet fed by the sheet stacker.

* * * * *